US006877453B2

(12) United States Patent
Hocquet et al.

(10) Patent No.: US 6,877,453 B2
(45) Date of Patent: Apr. 12, 2005

(54) DEFLECTOR DEVICES

(75) Inventors: Philippe Hocquet, Vanves (FR); Ottar Kristiansen, Oslo (NO)

(73) Assignee: WesternGeco, L.L.C., Houston, TX (US)

( * ) Notice: Subject to any disclaimer, the term of this patent is extended or adjusted under 35 U.S.C. 154(b) by 0 days.

(21) Appl. No.: 10/450,747

(22) PCT Filed: Dec. 12, 2001

(86) PCT No.: PCT/IB01/02498

§ 371 (c)(1),
(2), (4) Date: Oct. 21, 2003

(87) PCT Pub. No.: WO02/47966

PCT Pub. Date: Jun. 20, 2002

(65) Prior Publication Data

US 2004/0065244 A1 Apr. 8, 2004

(30) Foreign Application Priority Data

Dec. 16, 2000 (GB) ..... 0030746

(51) Int. Cl.[7] ..... B63G 21/66
(52) U.S. Cl. ..... 114/244; 114/245; 114/253
(58) Field of Search ..... 114/253, 245, 114/244

(56) References Cited

U.S. PATENT DOCUMENTS 3,613,629 A * 10/1971 Rhyne et al. ..... 114/245
3,703,876 A * 11/1972 Michelsen ..... 114/244
4,055,138 A * 10/1977 Klein ..... 114/244
6,234,102 B1 * 5/2001 Russell et al. ..... 114/253

FOREIGN PATENT DOCUMENTS

EP 0 613 025 A 8/1994
WO WO 00 76839 A 12/2000

* cited by examiner

*Primary Examiner*—Jesus D. Sotelo
(74) *Attorney, Agent, or Firm*—WesternGeco, L.L.C.

(57) ABSTRACT

A deflector device for use with a tow line between a seismic survey vessel and a tow, in particular a streamer or streamer array, in the water behind the vessel comprises a vertically oriented wing-shaped body for producing a sideways force as it is towed through the water, and a towing bridle adapted to connect the wing-shaped body to the tow line. The bridle comprises first and second connecting elements connected between the tow line and respective longitudinally-spaced points along the high pressure side of the wing-shaped body. The wing-shaped body includes one or more buoyancy elements to render it slightly positively buoyant, and the length of at least one of the connecting elements is adjustable by remote contol in order to tilt the wing-shaped body. This gives the sideways force a vertical component, and so allows remote control of the depth of the deflector device, as well as its lateral offset from the vessel.

30 Claims, 4 Drawing Sheets

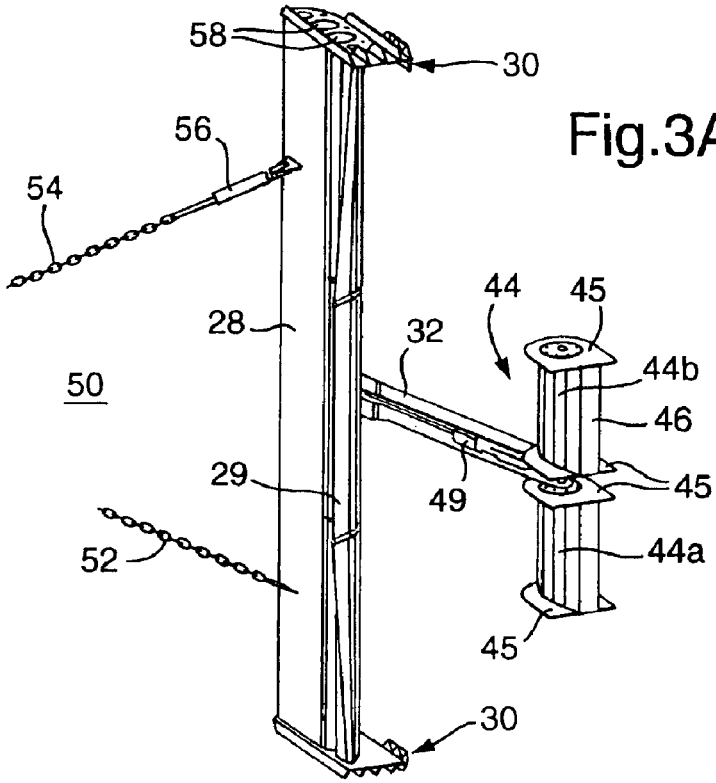
Fig.3A.
Fig.3C.
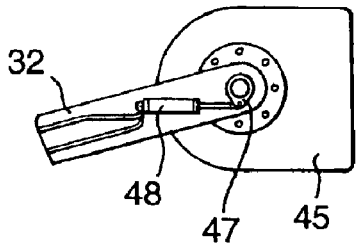
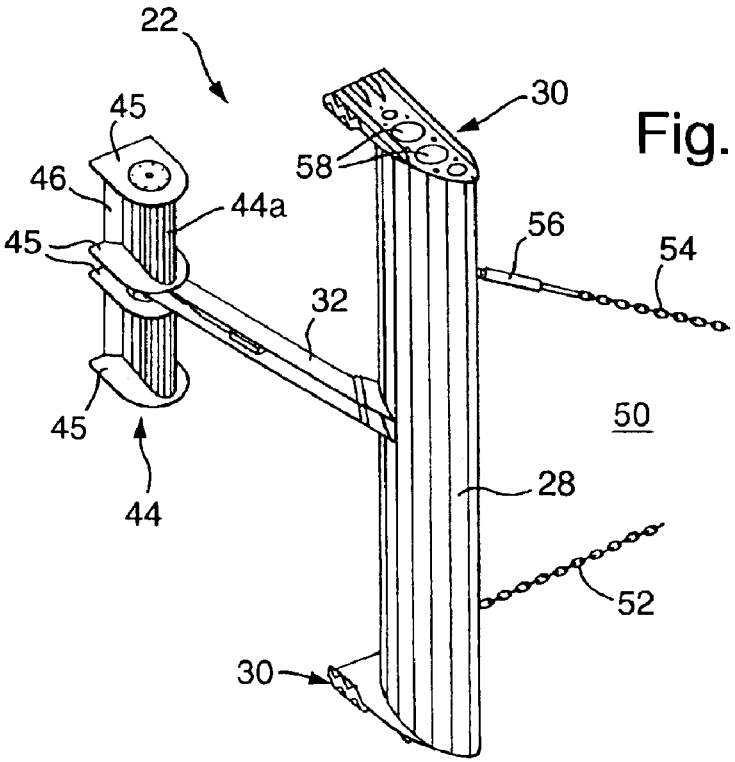
Fig.3B.

0° Angle of boom

10° Angle of boom

20° Angle of boom

DEFLECTOR DEVICES

This invention relates to deflector devices of the kind used between a towing vessel and a tow located in water, for example a seismic streamer or streamer array, or a seismic source array, in order to pull the tow out to one side of the vessel, so as to position it at a desired lateral offset from the course followed by the vessel.

DESCRIPTION OF THE RELATED ART

A deflector device of the kind used between a towing vessel and a tow located in water is described in detail in our U.S. Pat. No. 5,357,892, and comprises a wing-shaped deflector body having a remotely-operable pivotal lever or "boom" which extends rearwardly from a point near the middle of the trailing edge of the wing-shaped body. In use, the wing-shaped body is suspended beneath a float so as to be completely submerged and positioned generally vertically in the water, and is connected to the towing vessel by means of a tow line, while the tow is connected to the end of the boom remote from the wing-shaped body. As the device is pulled through the water, the wing-shaped body produces a sideways force, or "lift", which moves the tow laterally. This lift can be varied by adjusting the angle of the boom from the vessel, thus permitting the lateral offset of the tow from the course of the vessel to be varied in use.

The deflector device of U.S. Pat. No. 5,357,892 has been successfully commercialised by the Applicant as its MONOWING deflector device. In use, rolling stability of the device is provided by the connection to the float, while stability of the device about a vertical axis is provided by the drag produced by the tow.

The MONOWING deflector devices in current use are very large, typically 7.5 m high by 2.5 m wide, and weigh several tonnes. They are usually suspended around 2 m to 8 m below the float by means such as a fibre rope, and are also provided with a safety chain intended to prevent separation of the float and wing-shaped body in the event that the rope breaks. In rough weather, the upper part of the wing-shaped body may rise up out of the water, allowing the rope connecting the wing-shaped body and the float to go slack. If the wing-shaped body then drops abruptly, the rope, and possibly even the safety chain, may break, and/or their attachment points on the wing-shaped body may be badly damaged.

Additionally, the depth at which the current deflector device operates is effectively determined by the length of the rope connecting it to the float. As a result of this, the operating depth of the deflector device cannot readily be varied while the device is deployed in the water. And since the normal operating depth of the current deflector device is typically a few meters, in the event of the onset of bad weather, the device and all the streamers and other equipment directly or indirectly attached to it have to be recovered onto the towing vessel.

It is an object of the present invention to alleviate the drawbacks arising from the connection of the deflector device to the float.

SUMMARY OF THE INVENTION

According to the present invention, there is provided a deflector device for use with a tow line between a towing vessel and a tow in water behind the vessel, the device comprising a wing-shaped body, and a towing bridle adapted to connect the wing-shaped body to the tow line, the bridle comprising first and second connecting elements having respective first ends connected to respective longitudinally-spaced points along the high pressure side of the wing-shaped body and respective second ends adapted to be coupled to the tow line, and the wing-shaped body being shaped to produce in use a sideways force which urges the tow line laterally with respect to the direction of movement of the towing vessel, further comprising one or more buoyancy elements disposed within and/or secured to the upper end of the wing-shaped body, and remotely-operable means for adjusting the length of at least one of the connecting elements in order to tilt the wing-shaped body so as to give said sideways force a vertical component, whereby to control the depth of the deflector device as well as its lateral offset from the vessel.

It will be appreciated that since the deflector device of the invention can generate a controllable vertical force, this force, together with the buoyancy of the one or more buoyancy elements, can be selected and adjusted so that the separate surface float is no longer required, and the operating depth of the device can be remotely controlled while the device is deployed in the water. In particular, at the onset of bad weather, the deflector device and its tow can be caused to dive to a greater depth, where the effects of the bad weather are much reduced, until the weather improves.

Advantageously, the one or more buoyancy elements has or have a buoyancy selected to give the complete device a small positive buoyancy.

The remotely-operable adjusting means preferably comprises a telescopic member, which may be hydraulically actuated, connected in series in one of the connecting elements, which are advantageously titanium chains.

In a first implementation of the invention, the deflector device further comprises a boom extending rearwardly from the wing-shaped body, the end of the boom remote from the wing-shaped body being connected, in use, to the tow, and remotely-operable means for adjusting the angle between the boom and the wing-shaped body to vary the sideways force produced by the wing-shaped body.

In a second implementation of the invention, the deflector device further comprises a boom extending rearwardly from the wing-shaped body, an auxiliary wing-shaped body, smaller than the firstmentioned (or principal) wing-shaped body, secured to the end of the boom remote from the principal wing-shaped body and shaped so as to produce in use a sideways force in generally the opposite direction to that produced by the principal wing-shaped body, and remotely-operable means for adjusting the angle between the boom and the principal wing-shaped body to vary the sideways force produced by the principal wing-shaped body.

In a third and preferred implementation of the invention, the deflector device further comprises a boom extending rearwardly from the wing-shaped body, an auxiliary wing-shaped body, smaller than the firstmentioned (or principal) wing-shaped body, secured to the end of the boom remote from the principal wing-shaped body and shaped so as to produce in use a sideways force in generally the opposite direction to that produced by the principal wing-shaped body, and remotely-operable means for varying the angle of the auxiliary wing-shaped body to vary the sideways force produced by the auxiliary wing-shaped body, and thereby vary the sideways force produced by the principal wing-shaped body.

Advantageously, the auxiliary wing-shaped body is provided with a trailing edge flap angled away from the boom, typically at about 35°.

The invention also includes a method of performing a marine seismic survey, the method including towing a plurality of laterally spaced seismic steamers over an area to be surveyed, wherein the lateral position and the depth of at least one of the streamers are controlled by a deflector device in accordance with any one of the preceding statements of invention.

BRIEF DESCRIPTION OF THE DRAWINGS

The invention will now be described by way of example only, with reference to the accompanying drawings, of which:

FIGS. 3A and 3B are respective perspective views of the deflector device of FIG. 2;

FIG. 3C is a more detailed view of part of the deflector device of FIG. 2:

DETAILED DESCRIPTION OF SPECIFIC EMBODIMENTS

Figure 1:
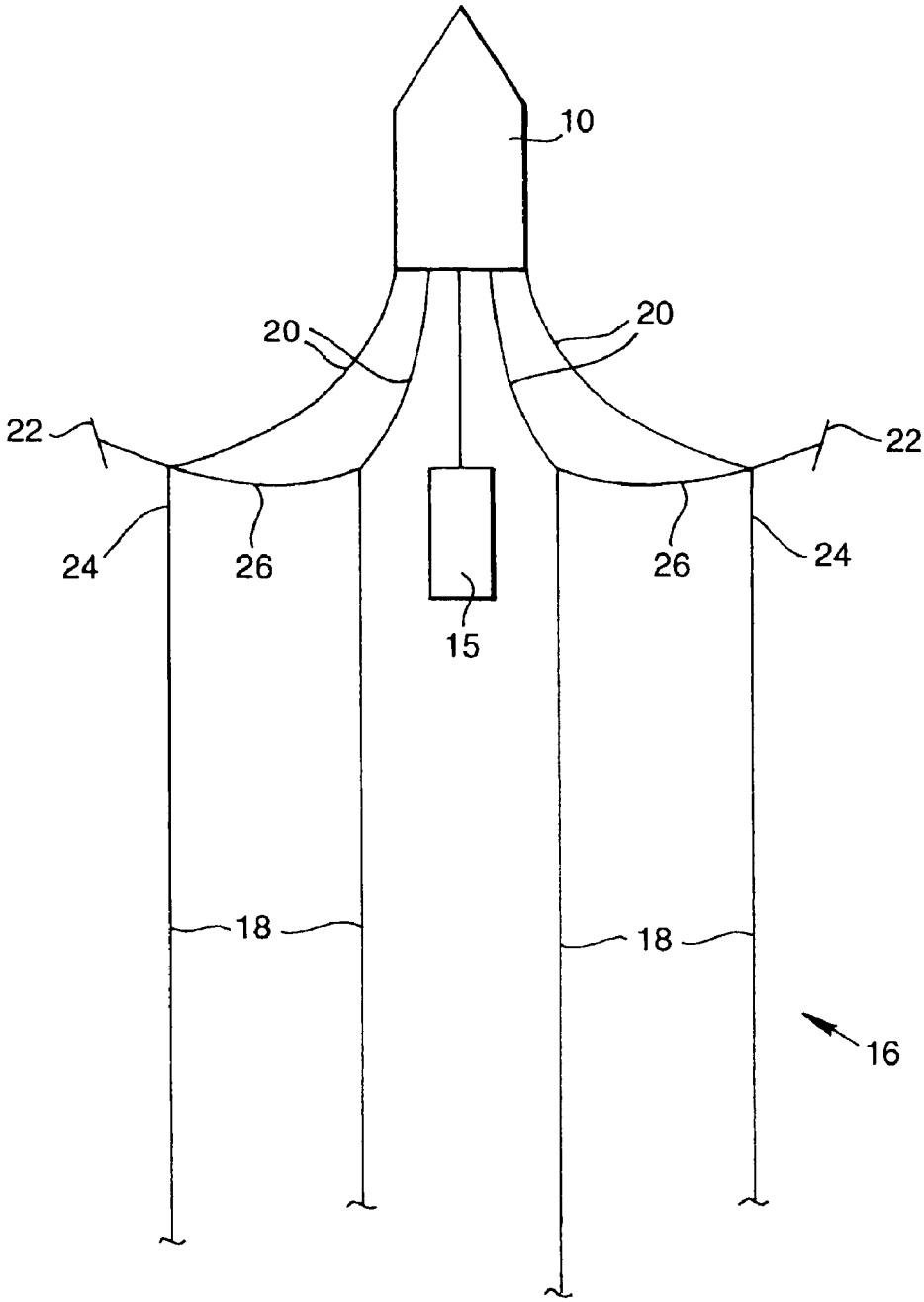
FIG. 1 is a somewhat schematic view of a seismic survey vessel carrying out a marine seismic survey.

The seismic survey vessel shown in FIG. 1 is indicated generally at 10, and is preferably as described in our PCT Patent Application No. PCT/GB98/01832 (WO 99/00295). The vessel 10 is shown towing a seismic source 15, typically a TRISOR multiple air gun source of the kind described in our U.S. Pat. No. 4,757,482, and an array 16 of four substantially identical streamers 18. However, it will be appreciated that, in practice, many more than four streamers can be towed, for example by using the techniques described in our PCT Patent Application No. PCT/IB98/01435 (WO 99/15913). The streamers 18 are towed by means of their respective lead-ins 20 (ie the high strength steel- or fibre-reinforced electrical or electro-optical cables which convey electrical power, control and data signals between the vessel 10 and the streamers), and their spread is controlled by two deflector devices, indicated at 22, connected to the respective forward ends 24 of the two outermost streamers. The deflector devices 22 act in co-operation with respective spreader lines 26 connected between the forward end 24 of each outermost streamer 18 and the forward end 24 of its adjacent streamer to maintain a substantially uniform spacing between the streamers.

Figure 2:
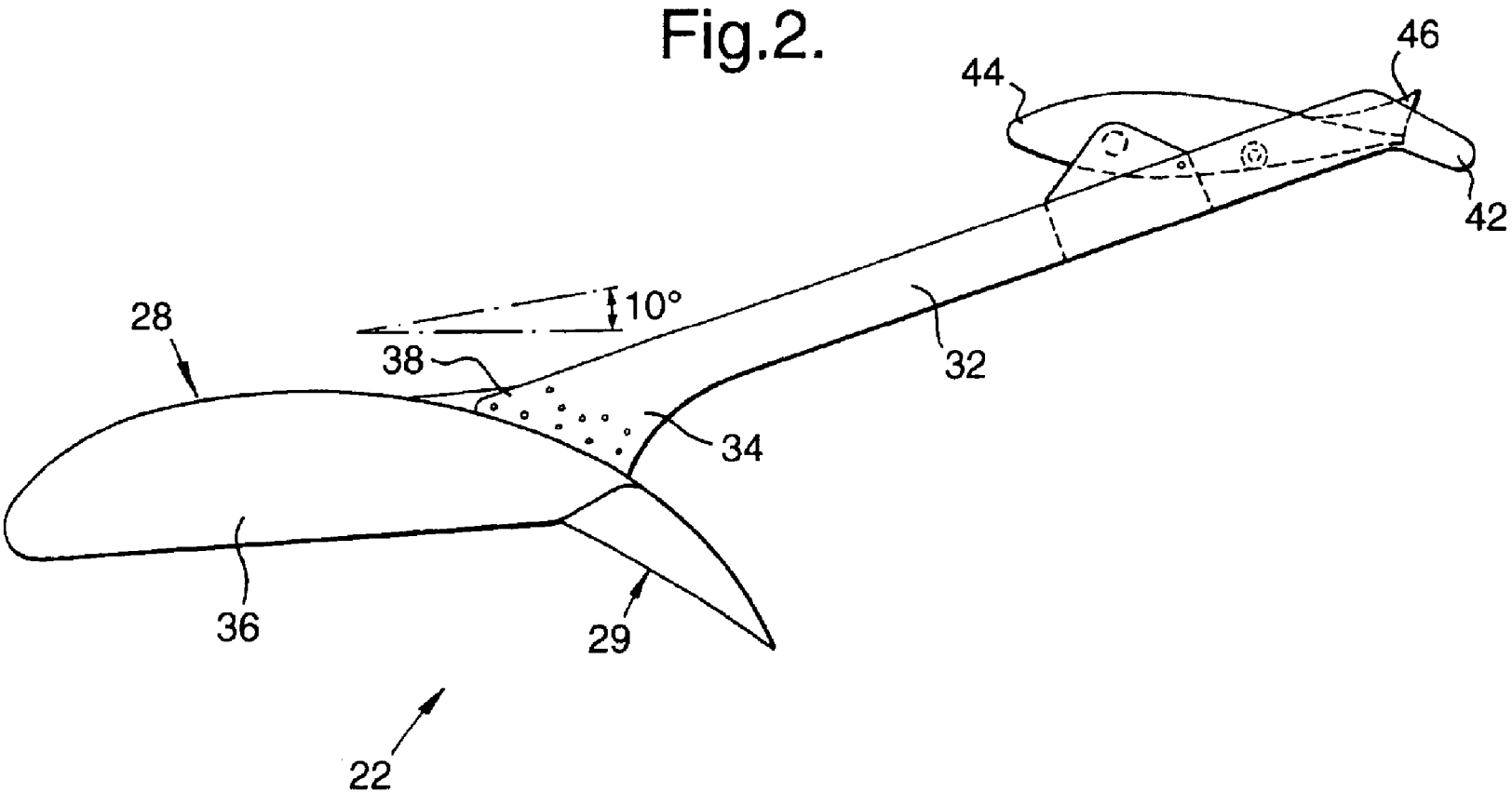
FIG. 2 is a somewhat schematic part-sectional view of a first embodiment of a deflector device in accordance with the present invention, for use in carrying out the survey of FIG. 1.

One of the deflector devices 22 is shown in section in FIG. 2. The deflector device 22 is similar in general principle to the deflector device of our U.S. Pat. No. 5,357,892, but is a much improved version of it. In particular, the deflector device 22 has a main wing-shaped body 28 which is coupled in use to a respective outer lead-in 20, and which corresponds to the deflector body 2 of U.S. Pat. No. 5,357,892. However, the main wing-shaped body 28 is of improved hydrodynamic cross-sectional shape and includes a fixed-angle trailing edge flap 29, both of which features enhance lift. Also, the main wing-shaped body 28 is provided with vortex controlling end plates 30 (see FIGS. 3A and 3B) of the kind described in our PCT Patent Application No. PCT/FR99/02272, to reduce drag and improve stability, and is largely made of titanium to reduce weight.

Additionally, the angle lever 10 of U.S. Pat. No. 5,357,892 is replaced by a rearwardly extending fixed angle boom 32, which is detachably connected at one end 34 to the low pressure side 36 of the body 28 near the trailing edge flap 29, at a mounting bracket 38. The boom 32 is of sandwich construction, and is made from two similarly shaped plates 39 which are bolted together at intervals along their length and which sandwich between them the mounting bracket 38. Typically, the boom 32 is detached whenever the deflector device 22 is on the vessel 10, for ease of stowage. The other end 40 of the boom 32 has a towing eye 42, coupled in use to the forward end 24 of a respective one of the two outermost streamers 18.

An auxiliary wing-shaped body 44, which is much smaller than the body 28 in length, thickness and chord, is pivotally secured as will be explained hereinafter to the end 40 of the boom 32, with its longitudinal axis (which lies in a plane perpendicular to the plane of FIG. 2) extending parallel to the longitudinal axis of the body 28. The shape of the body 44 is designed to produce, in use, a sideways force in a direction approximately opposite to that produced by the body 28 (approximately opposite, because as will become apparent, the direction of the force varies in use). This sideways force is increased by providing the body 44 with a fixed trailing edge flap 46, angled away from the boom 32 at an angle of about 35°.

As best seen in FIGS. 3A and 3B, the auxiliary wing-shaped body 44 is implemented in two symmetrical halves 44*a* and 44*b*, which each have vortex-reducing end plates 45 and which are disposed on opposite sides of the boom 32. The two halves 44*a*, 44*b* of the auxiliary wing-shaped body 44 are rotatable in unison about a common axis perpendicular to the plane of the boom 32, so as to vary the angle of the chord of the auxiliary wing-shaped body 44 with respect to the boom. Rotation of the auxiliary wing-shaped body 44 is effected by a telescopic actuator 48 pivotally mounted between the plates 39 of the boom 32, the actuator being pivotally connected to a lever arm or eccentric 47 attached to the two halves 44*a* and 44*b* of the auxiliary wing-shaped body 44 (see FIG. 3C). The telescopic actuator 48 is operated from a remotely-controllable electro-hydraulic control pack 49, which is also mounted between the plates 39 of the boom 32.

It will be appreciated that varying the angle of the auxiliary wing-shaped body 44 of the deflector device 22 changes the angle of the main wing-shaped body 28 with respect to the direction of tow, and so changes the lift produced by the main wing-shaped body. This in turn changes the lateral offset produced by the deflector device 22.

In accordance with the present invention, the deflector device 22 is made approximately neutrally buoyant, by including gas-filled pipe-like buoyancy elements 58 extending longitudinally within it from top to bottom, and/or by providing an integral buoyancy element at its upper end similar to but smaller than that described in our co-pending United Kingdom Patent Application Nos. 0023775.0, 0025719.6 & 0029451.2. In practice, the deflector device 22 is preferably designed to be slightly positively buoyant, so that in the event of a malfunction, it tends-to-float-rather than sink. Additionally, the main wing-shaped body 28 of the deflector device 22 is coupled to the respective lead-in 20 by a towing bridle 50 comprising two titanium chains 52 and 54, the chain 54 having a remotely operable, hydraulically actuated, telescopic strut 56 connected in series in it.

With the telescopic strut 56 in its mid-length position, the combined length of the chain 54 and the strut 56 is substantially equal to the length of the chain 52, which tends to hold the main wing-shaped body 28 in a substantially vertical attitude in the water, so that substantially all the force or "lift" generated by it is directed sideways, as in the prior art MONOWING deflector device, but with just enough of a downward component to counteract the slightly positive buoyancy mentioned above. However, changing the length of the strut 56 tends to tilt the main wing-shaped body 28 away from the vertical, so giving the sideways force generated by it a more significant vertical component in the upward or downward direction, and thus permitting the depth of the device to be varied.

It will be appreciated that as a result of making the deflector device 22 approximately neutrally buoyant and capable of generating a remotely-controllable vertical force, a separate surface float is no longer required, and the operating depth of the device can be remotely controlled while the device is deployed in the water. In particular, in the event of the onset of bad weather, the deflector device 22 and the streamers 18 attached to it can be caused to dive to a greater depth, where the effects of the bad weather are much reduced, until the bad weather passes.

Figure 4A:
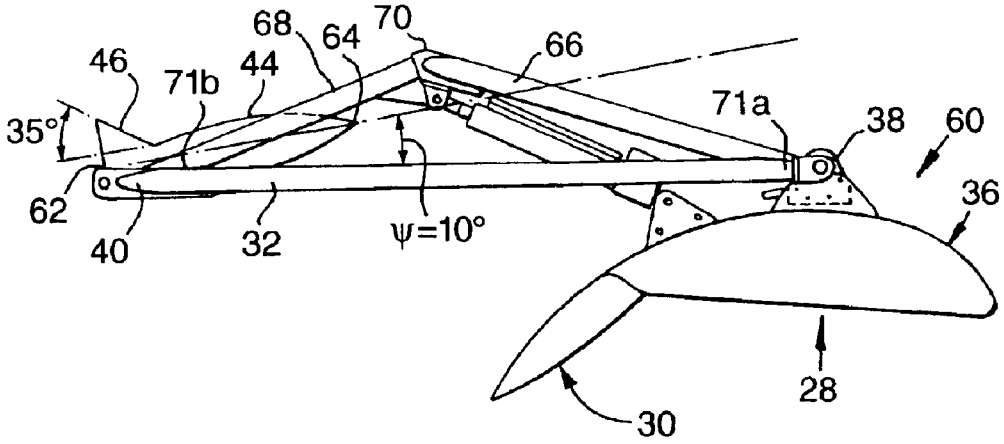
FIG. 4A is a somewhat schematic part-sectional view of a second embodiment of a deflector device in accordance with the present invention, for use in carrying out the survey of FIG. 1.
Figure 4B:
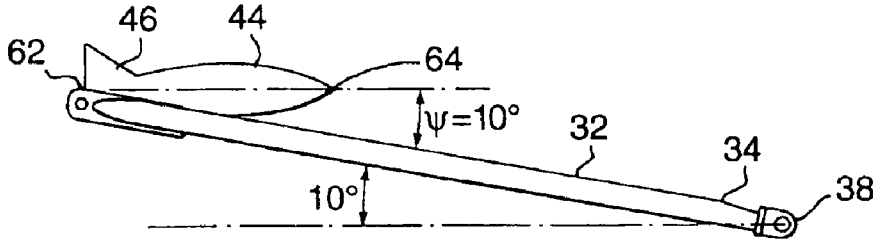
FIGS. 4B and 4C show different operating positions of part of the deflector device of FIG. 4A.
Figure 4C:
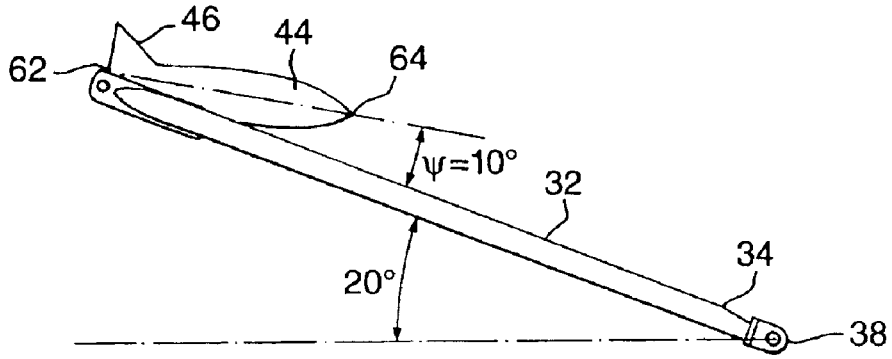

FIGS. 4A to 4C show at 60 an alternative embodiment of the deflector device 22 of FIGS. 2 and 3A to 3C, with corresponding parts having the same reference numbers as were used in FIGS. 2 and 3A to 3C. The principal difference between this alternative embodiment and the embodiment of FIGS. 2 and 3A to 3C is that in the deflector device 60, the boom 32 is pivotally connected to the low pressure side 36 of the main wing-shaped body 28 at the mounting bracket 38, while the auxiliary wing-shaped body 44 is fixedly secured at or near the midpoint of its trailing edge 62 to the end 40 of the boom 32, with its leading edge 64 inclined away from the body 28 such that the chord of the body 44 is inclined at an angle of about 10° to the boom.

Pivotal movement of the boom 32 is controlled by a mechanism comprising first and second struts 66, 68, which are pivotally connected to each other at 70 and to each end of the boom at 71*a* and 71*b*, forming with the boom a triangle, and an extending hydraulic actuator strut 72 pivotally connected between the apex of the triangle, ie the pivotal connection point 70 of the struts 66, 68, and a pivotal connection point 74 positioned on the low pressure side 36 of the body 28 between its midpoint and its trailing edge. The actuator strut 72 is connected to be operated by a remotely-operable hydraulic control system (not shown) disposed within the body 28.

It will be appreciated that extension of the hydraulic actuator strut 72, from its unextended position of FIG. 4A, will move the boom 32 outwardly from the low pressure side 36 of the body 28, from its closest position shown in FIG. 4A. The extent of the outward movement is preferably about 209, as shown in FIGS. 4B and 4C.

As the boom 32 is pivoted away from the body 28, the sideways force produced by the body 44 acts as a restoring force, and thus varies the angle of the body 28 with respect to the direction of tow, so changing the lift produced by the body 28. This restoring force augments the restoring force produced by the drag of the towed streamer 18 (and in particular, reduces the effect of any stability-reducing variations or reductions in that drag). Indeed, the deflector device 60 will remain stable with no streamer attached, eg if its streamer 18 breaks or is severed at its forward end 24 (this is also true for the deflector device 22 of FIGS. 2 and 3A to 3C).

It will be appreciated that many modifications can be made to the described embodiments of the invention.

In particular, the titanium chains 52, 54 of the towing bridle 50 can be replaced by cables made from high strength fibres, eg Kevlar fibres, while the telescopic strut 56 can be replaced by any other suitable hydraulic or electric mechanism for changing the relative lengths of the chains or cables, which mechanism can be housed inside the body 28 and arranged to retract or pay out one or both of the chains or cables. And the auxiliary wing-shaped body 44 can be made from a plastics material reinforced with high strength fibres, eg Kevlar fibres, and, in the deflector device 22, electrically operated rather than operated by the hydraulic actuator 48.

Additionally, the devices 22 and 60 can be used with tows other than streamers, for example seismic sources, and the tow need not be connected to the end 40 of the boom 32 (it could instead be connected to the lead-in 20, at a point near where the bridle 24 is connected to the lead-in). Also, the invention can if desired be used with a deflector device like that described in our U.S. Pat. No. 5,357,892, ie a deflector device without the auxiliary wing-shaped body 44.

Finally, although the invention has been described in relation to deflector devices whose lift can be varied by varying the angle of the device with respect to the direction of tow, it is also applicable in its broadest aspect to a fixed angle deflector device, eg of the kind referred to as a "door".

What is claimed is:

1. A deflector device for use with a tow line between a towing vessel and a tow in water behind the vessel, the device comprising a wing-shaped body, and a towing bridle adapted to connect the wing-shaped body to the tow line, the bridle comprising first and second connecting elements having respective first ends connected to respective longitudinally-spaced points along the high pressure side of the wing-shaped body and respective second ends adapted to be coupled to the tow line, and the wing-shaped body being shaped to produce in use a sideways force which urges the tow line laterally with respect to the direction of movement of the towing vessel, further comprising at least one buoyancy element disposed within the upper end of the wing-shaped body, and remotely-operable means for adjusting the length of at least one of the connecting elements in order to tilt the wing-shaped body so as to give said sideways force a vertical component, whereby to control the depth of the deflector device as well as its lateral offset from the vessel.

2. A deflector device as claimed in claim 1, wherein said at least one buoyancy element has a buoyancy selected to give the deflector device a small positive buoyancy.

3. A deflector device as claimed in claim 1, wherein the remotely-operable adjusting means comprises a telescopic member connected in series in one of the connecting elements.

4. A deflector device as claimed in claim 3, wherein the telescopic member is hydraulically operated.

5. A deflector device as claimed in claim 1, wherein the connecting elements are chains.

6. A deflector device as claimed in claim 5, wherein the chains are titanium chains.

7. A deflector device as claimed in claim 1, further comprising a boom extending rearwardly from the wing-shaped body, the end of the boom remote from the wing-shaped body being connected, in use, to the tow, and remotely-operable means for adjusting the angle between the boom and the wing-shaped body to vary the sideways force produced by the wing-shaped body.

8. A deflector device as claimed in claim 1, further comprising a boom extending rearwardly from the wing-shaped body, an auxiliary wing-shaped body, smaller than the principal wing-shaped body, secured to the end of the boom remote from the principal wing-shaped body and shaped so as to produce in use a sideways force in generally the opposite direction to that produced by the principal wing-shaped body, and remotely-operable means for adjusting the angle between the boom and the principal wing-shaped body to vary the sideways force produced by the principal wing-shaped body.

9. A deflector device as claimed in claim 1, further comprising a boom extending rearwardly from the wing-shaped body, an auxiliary wing-shaped body, smaller than the principal wing-shaped body, secured to the end of the boom remote from the principal wing-shaped body and shaped so as to produce in use a sideways force in generally the opposite direction to that produced by the principal wing-shaped body, and remotely-operable means for varying the angle of the auxiliary wing-shaped body to vary the sideways force produced by the auxiliary wing-shaped body, and thereby vary the sideways force produced by the principal wing-shaped body.

10. A deflector device as claimed in claim 8, wherein the auxiliary wing-shaped body is provided with a trailing edge flap angled away from the boom.

11. A deflector device as claimed in claim 10, wherein the auxiliary wing-shaped body is provided with a trailing edge flap angled away from the boom at about 35°.

12. A method of performing a marine seismic survey, the method comprising:

towing a plurality of laterally spaced seismic steamers over an area to be surveyed; and controlling a lateral position and a depth of at least one of the streamers using a deflector device for use with a tow line between a towing vessel and a tow in water behind the vessel, the deflector device comprising a wing-shaped body, and a towing bridle adapted to connect the wing-shaped body to the tow line, the bridle comprising first and second connecting elements having respective first ends connected to respective longitudinally-spaced points along the high pressure side of the wing-shaped body and respective second ends adapted to be coupled to the tow line, and the wing-shaped body being shaved to produce in use a sideways force which urges the tow line laterally with respect to the direction of movement of the towing vessel, further comprising at least one buoyancy element disposed within the upper end of the wing-shaped body, and remotely-operable means for adjusting the length of at least one of the connecting elements in order to tilt the wing-shaped body so as to give said sideways force a vertical component, whereby to control the depth of the deflector device as well as its lateral offset from the vessel.

13. A method as claimed in claim 12, wherein the deflector device comprises at least one buoyancy element, and further comprising selecting a buoyancy of said at least one buoyancy element to give the deflector device a small positive buoyancy.

14. A method as claimed in claim 12, wherein controlling the lateral position and the depth comprises adjusting a telescopic member connected in series in one of the connecting elements.

15. A method as claimed in claim 12, further comprising a boom extending rearwardly from the wing-shaped body, the end of the boom remote from the wing-shaped body being connected, in use, to the tow, and wherein controlling the lateral position and the depth comprises adjusting the angle between the boom and the wing-shaped body to vary the sideways force produced by the wing-shaped body.

16. A deflector device for use with a tow line between a towing vessel and a tow in water behind the vessel, the device comprising a wing-shaped body, and a towing bridle adapted to connect the wing-shaped body to the tow line, the bridle comprising first and second connecting elements having respective first ends connected to respective longitudinally-spaced points along the high pressure side of the wing-shaped body and respective second ends adapted to be coupled to the tow line, and the wing-shaped body being shaped to produce in use a sideways force which urges the tow line laterally with respect to the direction of movement of the towing vessel, further comprising at least one buoyancy element secured to the upper end of the wing-shaped body, and remotely-operable means for adjusting the length of at least one of the connecting elements in order to tilt the wing-shaped body so as to give said sideways force a vertical component, whereby to control the depth of the deflector device as well as its lateral offset from the vessel.

17. A deflector device as claimed in claim 16, wherein said at least one buoyancy element has a buoyancy selected to give the deflector device a small positive buoyancy.

18. A deflector device as claimed in claim 16, wherein the remotely-operable adjusting means comprises a telescopic member connected in series in one of the connecting elements.

19. A deflector device as claimed in claim 18, wherein the telescopic member is hydraulically operated.

20. A deflector device as claimed in claim 16, wherein the connecting elements are chains.

21. A deflector device as claimed in claim 20, wherein the chains are titanium chains.

22. A deflector device as claimed in claim 16, further comprising a boom extending rearwardly from the wing-shaped body, the end of the boom remote from the wing-shaped body being connected, in use, to the tow, and remotely-operable means for adjusting the angle between the boom and the wing-shaped body to vary the sideways force produced by the wing-shaped body.

23. A deflector device as claimed in claim 16, further comprising a boom extending rearwardly from the wing-shaped body, an auxiliary wing-shaped body, smaller than the principal wing-shaped body, secured to the end of the boom remote from the principal wing-shaped body and shaped so as to produce in use a sideways force in generally the opposite direction to that produced by the principal wing-shaped body, and remotely-operable means for adjusting the angle between the boom and the principal wing-shaped body to vary the sideways force produced by the principal wing-shaped body.

24. A deflector device as claimed in claim 16, further comprising a boom extending rearwardly from the wing-shaped body, an auxiliary wing-shaped body, smaller than the principal wing-shaped body, secured to the end of the boom remote from the principal wing-shaped body and shaped so as to produce in use a sideways force in generally the opposite direction to that produced by the principal wing-shaped body, and remotely-operable means for varying the angle of the auxiliary wing-shaped body to vary the sideways force produced by the auxiliary wing-shaped body, and thereby vary the sideways force produced by the principal wing-shaped body.

25. A deflector device as claimed in claim 24, wherein the auxiliary wing-shaped body is provided with a trailing edge flap angled away from the boom.

26. A deflector device as claimed in claim 25, wherein the auxiliary wing-shaped body is provided with a trailing edge flap angled away from the boom at about 35°.

27. A method of performing a marine seismic survey, the method comprising:

towing a plurality of laterally spaced seismic steamers over an area to be surveyed; and controlling a lateral position and a depth of at least one of the streamers using a deflector device for use with a tow line between a towing vessel and a tow in water behind the vessel, the device comprising a wing-shaped body, and a towing bridle adapted to connect the wing-shaped body to the tow line, the bridle comprising first and second connecting elements having respective first ends connected to respective longitudinally-spaced points along the high pressure side of the wing-shaped body and respective second ends adapted to be coupled to the tow line, and the wing-shaped body being shaped to produce in use a sideways force which urges the tow line laterally with respect to the direction of movement of the towing vessel, further comprising at least one buoyancy element secured to the upper end of the wing-shaped body, and remotely-operable means for adjusting the length of at least one of the connecting elements in order to tilt the wing-shaped body so as to give said sideways force a vertical component, whereby to control the depth of the deflector device as well as its lateral offset from the vessel.

28. A method as claimed in claim 27, wherein the deflector device comprises at least one buoyancy element, and further comprising selecting a buoyancy of said at least one buoyancy element to give the deflector device a small positive buoyancy.

29. A method as claimed in claim 27, wherein controlling the lateral position and the depth comprises adjusting a telescopic member connected in series in one of the connecting elements.

30. A method as claimed in claim 27, further comprising a boom extending rearwardly from the wing-shaped body, the end of the boom remote from the wing-shaped body being connected, in use, to the tow, and wherein controlling the lateral position and the depth comprises adjusting the angle between the boom and the wing-shaped body to vary the sideways force produced by the wing-shaped body.

* * * * *